United States Patent [19]

Akasaki et al.

[11] Patent Number: 5,024,911

[45] Date of Patent: Jun. 18, 1991

[54] ELECTROPHOTOGRAPHIC PHOTORECEPTOR HAVING AN ELECTRIC CHARGE GENERATING LAYER COMPRISING A PYRYLIUM COMPOUND

[75] Inventors: Yutaka Akasaki; Hidekazu Aonuma; Katsumi Nukada; Akihiko Tokita; Hidemi Suto; Katsuhiro Sato; Hiroyuki Tanaka, all of Kanagawa, Japan

[73] Assignee: Fuji Xerox Co., Ltd., Tokyo, Japan

[21] Appl. No.: 201,203

[22] Filed: Jun. 2, 1988

[30] Foreign Application Priority Data

Jun. 3, 1987 [JP] Japan ..... 62-138289

[51] Int. Cl.[5] ..... G03G 15/02; G03G 15/09; G03G 15/00; G03G 15/06

[52] U.S. Cl. ..... 430/58; 430/83; 430/72

[58] Field of Search ..... 430/58, 83, 72

[56] References Cited

U.S. PATENT DOCUMENTS

| | | | |
|---|---|---|---|
| 3,141,770 | 7/1964 | Davis et al. | 430/83 X |
| 3,586,500 | 6/1971 | Contois et al. | 430/83 X |
| 3,684,548 | 8/1972 | Contois | 430/83 X |
| 3,896,112 | 7/1975 | Kubota et al. | 430/83 X |
| 4,389,474 | 6/1983 | Kawamura et al. | 430/83 X |
| 4,650,737 | 3/1987 | Wiedemann | 430/58 X |
| 4,724,192 | 2/1988 | Makino et al. | 430/58 |
| 4,725,519 | 2/1988 | Suzuki et al. | 430/78 X |
| 4,734,348 | 3/1988 | Suzuki et al. | 430/58 X |
| 4,835,079 | 5/1989 | Fujimura et al. | 430/58 |
| 4,882,257 | 11/1989 | Maruyama et al. | 430/100 |

FOREIGN PATENT DOCUMENTS 4028499 10/1961 Japan .

51-88226 8/1976 Japan .

*Primary Examiner*—Marion E. McCamish
*Assistant Examiner*—Stephen C. Crossan
*Attorney, Agent, or Firm*—Finnegan, Henderson, Farabow, Garrett and Dunner

[57] ABSTRACT

An electrophotographic photoreceptor is disclosed, comprising an electrically conductive substrate having thereon and a light-sensitive layer, said light-sensitive layer comprising an electric charge generating layer and an electric charge transporting layer, wherein the electric charge generating layer contains an electric charge generating organic pigment having positive hole transporting properties and a pyrylium compound represented by the formula (I) or (II):

(I)

(II)

wherein X is an oxygen atom or a sulfur atom; $R_1$ to $R_5$ are each a hydrogen atom, and alkyl group, a cycloalkyl group, an alkoxycarbonyl group, a benzyl group, a substituted or unsubstituted styryl group, or a substituted or unsubstituted phenyl group, and $Z^{\ominus}$ is an anion.

14 Claims, 3 Drawing Sheets

ELECTROPHOTOGRAPHIC PHOTORECEPTOR HAVING AN ELECTRIC CHARGE GENERATING LAYER COMPRISING A PYRYLIUM COMPOUND

FIELD OF THE INVENTION

The present invention relates to an electrophotographic photoreceptor and more particularly to an electrophotographic photoreceptor having increased light sensitivity.

BACKGROUND OF THE INVENTION

It is well known that spectral sensitization or chemical sensitization is achieved by adding a pyrylium-based compound to a light-sensitive layer of an electrophotographic light-sensitive material.

Japanese Patent Publication No. 28499/65 discloses that a pyrylium-based compound and a thiapyrylium-based compound are added in combination with an organic compound such as a light-sensitive or light-insensitive resin, anthracene, anthraquinone and polyvinyl carbazole, or with an inorganic substance such as selenium to increase the sensitivity of the light-sensitive layer and to extend the spectral sensitivity and spectral range.

When a pyrylium-based compound is added to an electrophotographic photoreceptor, the light sensitivity of the photoreceptor is increased and the light-sensitive wavelength region is extended to longer wavelengths. It is believed that the above phenomenon occurs because a pyrylium compound absorbs light and generates an electric charge, specifically, the pyrylium compound absorbs light, becomes excited, and in this light excited condition, an electron migrates from a photoconductive substance, leading to generation of an electric charge. Extension of the wavelength region to longer wavelengths correlates to the absorption spectrum of a pyrylium-based compound.

In recent years, an electrophotographic photoreceptor of the laminate type wherein the function is separated into an electric charge-generating layer and an electric charge-transporting layer has been investigated. A layer in which an electric charge-generating organic pigment is dispersed is mainly used as the electric charge-generating layer. Various pigments, such as those having sensitivity to wavelengths ranging from visible light to the infrared ray region, or those having sensitivity only to visible light, or those having sensitivity only to infrared rays, have been proposed as electric charge-generating organic pigments. By properly selecting the electric charge-generating organic pigment, it is now possible to impart sensitivity in the desired spectral sensitive region.

The above laminate type electrophotographic photoreceptor using a pyrylium-based compound has been described in Japanese Patent Application (OPI) No. 88226/76. The term "OPI" as used herein means an "unexamined published patent application". An electrophotographic photoreceptor is disclosed in which an eutectic complex is formed by adding a pyrylium-based compound to a polymer having an alkylidenediarylene group as the repeating unit, e.g., a polycarbonate resin is used in an electric charge-generating layer.

The electrophotographic photoreceptor disclosed in this patent shows a spectral sensitive spectrum different from the spectral sensitive spectrum of the original pyrylium-based compound.

However, if the aforementioned pyrylium-based compound is added to the electric charge-generating layer for the purpose of increasing the light sensitivity of the electric charge-generating organic pigment, the resulting electrophotographic photoreceptor has a greatly increased rate of dark-damping. Thus, the electrification properties of the photoreceptor are reduced, and the photoreceptor is not suitable for practical use.

SUMMARY OF THE INVENTION

The present invention overcome the problems and disadvantages of the prior art by providing an electrophotographic photoreceptor in which the absolute value of only the sensitivity is increased without changing the shape of the spectral sensitive spectrum of the electrophotographic photoreceptor.

An object of the present invention is to provide an electrophotographic photoreceptor having good charging properties in which the rate of dark-damping is not increased even if a pyrylium-based compound is added.

Additional objects and advantages of the invention will be set forth in part in the description which follows, and in part will be obvious from the description, or may be learned by practice of the invention. The objects and advantages of the invention will be realized and attained by means of the instrumentalities and combinations, particularly pointed out in the appended claims.

To achieve the objects and in accordance with the purpose of the invention, there is provided an electrophotographic photoreceptor comprising an electrically conductive substrate having thereon a light-sensitive layer comprising an electric charge-generating layer and an electric charge transporting layer, wherein the electric charge-generating layer contains an electric charge-generating organic pigment having positive hole transporting properties, and a pyrylium compound represented by the formula (I) or (II):

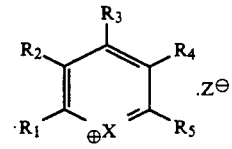

(I)

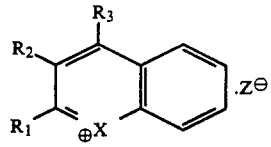

(II)

wherein X is an oxygen atom or a sulfur atom; $R_1$ to $R_5$ are each hydrogen, alkyl group, a cycloalkyl group, an alkoxycarbonyl group, a benzyl group, a substituted or unsubstituted styryl group, or a substituted or unsubstituted phenyl group, and $Z\ominus$ is an anion. Pyrylium compounds preferred for use in the invention are described hereinbelow.

The accompanying drawings, which are incorporated in and constitute a part of this specification, illustrate two exemplary embodiments of the invention and together with the description, serve to explain the principles of the invention.

DETAILED DESCRIPTION OF THE INVENTION

Figure 1:
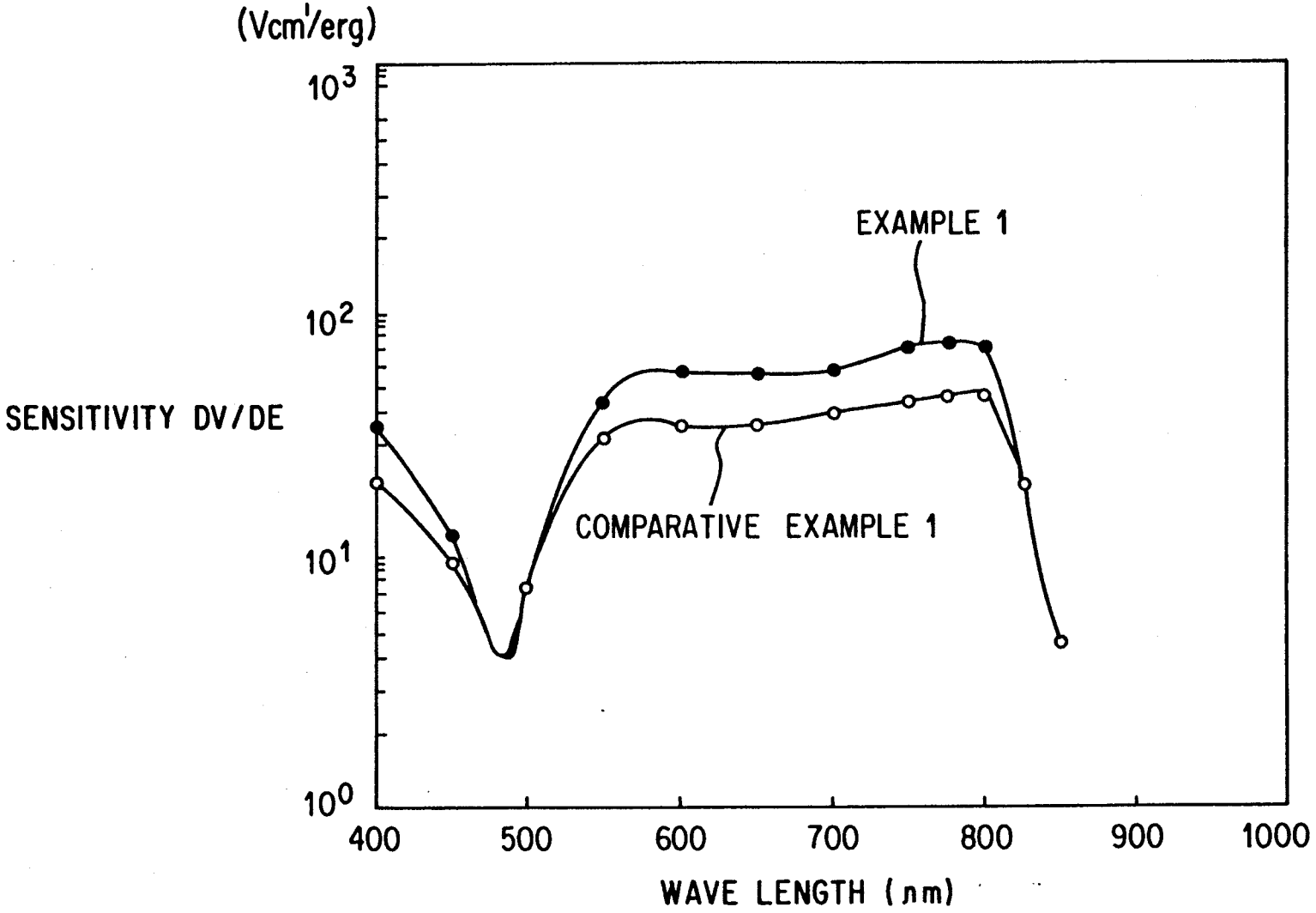
FIG. 1 is a graph showing spectral sensitivities of the electrophotographic photoreceptor of Example 1 of the present invention and Comparative Example 1.

Reference will now be made in detail to the present preferred embodiments of the invention, examples of which are illustrated in the accompanying drawings.

Suitable materials for use as the electrically conductive substrate of the electrophotographic photoreceptor of the present invention include electrically conductive material, such as: a metal plate, metal drum or metal foil made of, e.g., aluminum, nickel, chromium or stainless steel; a plastic film with a thin film of an electrically conductive substance provided thereon; or paper or plastic film coated or impregnated with an electric conductivity imparting agent.

The electric charge-generating layer constituting the light-sensitive layer on the electrically conductive substrate contains an electric charge-generating pigment having positive hole transporting properties and a pyrylium compound.

Pyrylium compounds to be used in the present invention are represented by the formula (I) or (II):

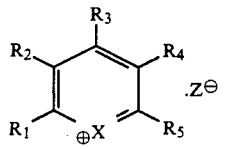

(I)

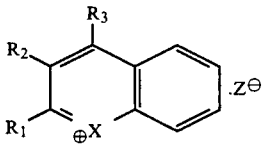

(II)

wherein X is an oxygen atom or a sulfur atom; $R_1$ to $R_5$ are each hydrogen; an alkyl group having 1 to 20 carbon atoms, such as methyl, ethyl, propyl, isopropyl, butyl, tertbutyl, amyl, isoamyl, hexyl, octyl, nonyl, dodecyl and stearyl; a cycloalkyl group such as a cyclohexyl group; an alkoxycarbonyl group, such as a methoxycarbonyl group and an ethoxycarbonyl group; a benzyl group; a substituted or unsubstituted styryl group, such as a styryl group and a p-methoxystyryl group; or a substituted or unsubstituted phenyl group, such as an alkylphenyl group (e.g., a phenyl group, a 4-methylphenyl group and a 4-ethylphenyl group), an alkoxyphenyl group (e.g., a 4-methoxy-phenyl group), a halophenyl group (e.g., a 4-chlorophenyl group, a 2,4-dichlorophenyl group), and an aminophenyl group (e.g., a 4-dimethylaminophenyl group, a 4-diethylaminophenyl group), and Z⊖ is an anion as described in Table A (particularly preferably being a halogen group, $ClO_4^-$, $BF_4^-$ and

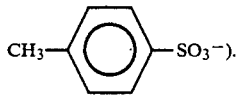

Preferred pyrylium compounds include pyrylium salts represented by the formula (III) or (IV):

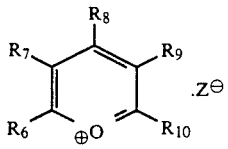

(III)

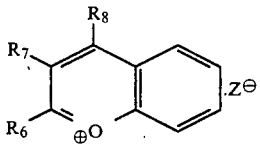

(IV)

wherein $R_6$ to $R_{10}$ are each hydrogen, an alkyl group, or a substituted or unsubstituted phenyl group, and Z⊖ is an anion. The alkyl group, the substituted or unsubstituted phenyl group and the anion are the same as those for $R_1$ to $R_5$ in formula (I) and (II).

Exemplary suitable pyrylium compounds used in the present invention are shown below in Table A.

TABLE A

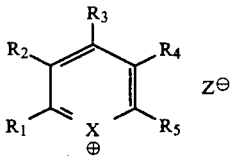

| No. | X | $R_1$ | $R_2$ | $R_3$ | $R_4$ | $R_5$ | Z⊖ |
|---|---|---|---|---|---|---|---|
| 1 | O | 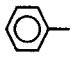 | H— | 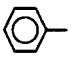 | H— | 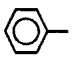 | $ClO_4^-$ |
| 2 | O | 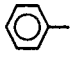 | H— | 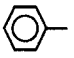 | H— | 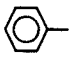 | $BF_4^-$ |
| 3 | O | 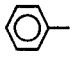 | H— | 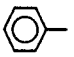 | H— | 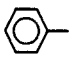 | $Cl^-$ |
| 4 | O | 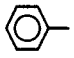 | H— | 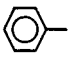 | H— | 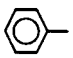 | 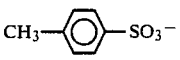 |

TABLE A-continued
| | | | | | | | | |
|---|---|---|---|---|---|---|---|---|
| 5 | O | 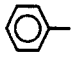 | H— | 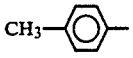 | H— | 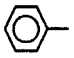 | $ClO_4^-$ |
| 6 | O | 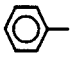 | H— | 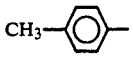 | H— | 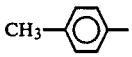 | $BF_4^-$ |
| 7 | O | 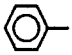 | H— | 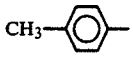 | H— | 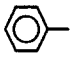 | 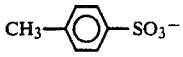 |
| 8 | O | 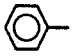 | H— | 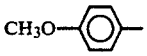 | H— | 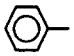 | $ClO_4^-$ |
| 9 | O | 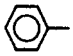 | H— | 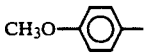 | H— | 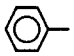 | $BF_4^-$ |
| 10 | O | 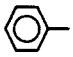 | H— | 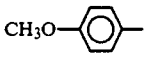 | H— | 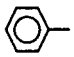 | 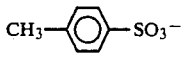 |
| 11 | O | 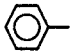 | H— | 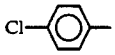 | H— | 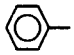 | $ClO_4^-$ |
| 12 | O | 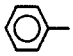 | H— | 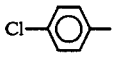 | H— | 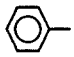 | $BF_4^-$ |
| 13 | O | 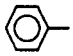 | H— | 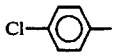 | H— | 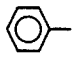 | $I^-$ |
| 14 | O | 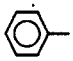 | H— | 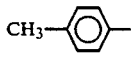 | H— | 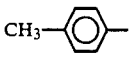 | $ClO_4^-$ |
| 15 | O | 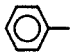 | H— | 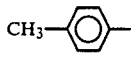 | H— | 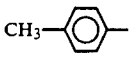 | $BF_4^-$ |
| 16 | O | 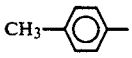 | H— | 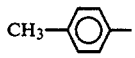 | H— | 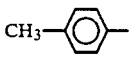 | $ClO_4^-$ |
| 17 | O | 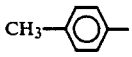 | H— | 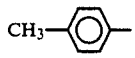 | H— | 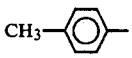 | 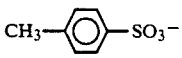 |
| 18 | O | 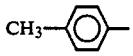 | H— | 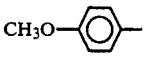 | H— | 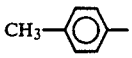 | $ClO_4^-$ |
| 19 | O | 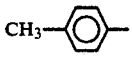 | H— | 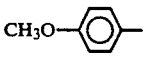 | H— | 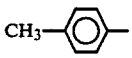 | $BF_4^-$ |
| 20 | O | 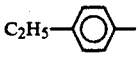 | H— | 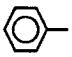 | H— | 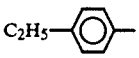 | $ClO_4^-$ |
| 21 | O | 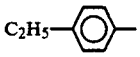 | H— | 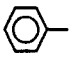 | H— | 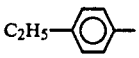 | $BF_4^-$ |
| 22 | O | 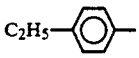 | H— | 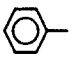 | H— | 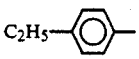 | 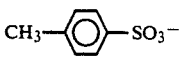 |
| 23 | O | 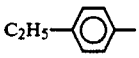 | H— | 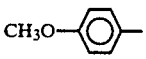 | H— | 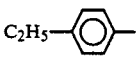 | $ClO_4^-$ |
| 24 | O | 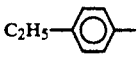 | H— | 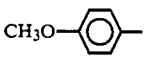 | H— | 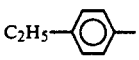 | $BF_4^-$ |

TABLE A-continued

| | | | | | | | |
|---|---|---|---|---|---|---|---|
| 25 | O | 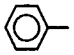 | H— | 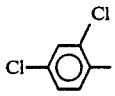 | H— | 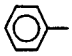 | $ClO_4^-$ |
| 26 | O | 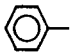 | H— | 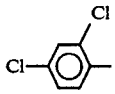 | H— | 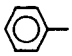 | $BF_4^-$ |
| 27 | O | $CH_3$— | H— | 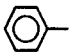 | H— | $CH_3$— | $ClO_4^-$ |
| 28 | O | $CH_3$— | H— | 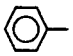 | H— | $CH_3$— | $BF_4^-$ |
| 29 | O | $C_2H_5$— | H— | 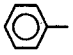 | H— | 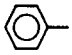 | $BF_4^-$ |
| 30 | O | $C_2H_5$— | H— | 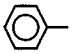 | H— | 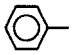 | $ClO_4^-$ |
| 31 | O | n-$C_3H_7$— | H— | 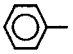 | H— | 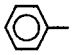 | $BF_4^-$ |
| 32 | O | n-$C_3H_7$— | H— | 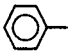 | H— | 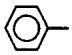 | $ClO_4^-$ |
| 33 | O | $CH_3$— | H— | $CH_3$— | H— | 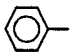 | $BF_4^-$ |
| 34 | O | $CH_3$— | H— | $CH_3$— | H— | 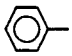 | $ClO_4^-$ |
| 35 | O | $CH_3$— | H— | 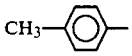 | H— | 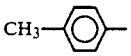 | $BF_4^-$ |
| 36 | O | $CH_3$— | H— | 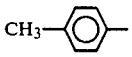 | H— | 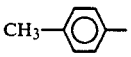 | $ClO_4^-$ |
| 37 | O | $C_2H_5$— | H— | 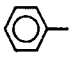 | H— | $C_2H_5$— | $BF_4^-$ |
| 38 | O | $C_2H_5$— | H— | 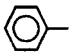 | H— | $C_2H_5$— | $ClO_4^-$ |
| 39 | O | 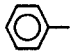 | H— | $CH_3$— | H— | 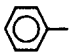 | $BF_4^-$ |
| 40 | O | 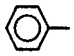 | H— | $CH_3$— | H— | 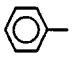 | $ClO_4^-$ |
| 41 | O | $CH_3$— | H— | $CH_3$— | H— | $CH_3$— | $BF_4^-$ |
| 42 | O | $CH_3$— | H— | $CH_3$— | H— | $CH_3$— | $ClO_4^-$ |
| 43 | O | $CH_3$— | H— | $CH_3$— | H— | $C_2H_5$ | $ClO_4^-$ |
| 44 | O | $CH_3$— | H— | $CH_3$— | H— | $C_2H_5$ | $BF_4^-$ |
| 45 | O | $CH_3$— | H— | $C_2H_5$— | H— | $CH_3$— | $ClO_4^-$ |
| 46 | O | $CH_3$— | H— | $C_2H_5$— | H— | $CH_3$— | $BF_4^-$ |
| 47 | O | n-$C_3H_7$— | H— | $CH_3$— | H— | n-$C_3H_7$— | $ClO_4^-$ |
| 48 | O | n-$C_3H_7$— | H— | $CH_3$— | H— | n-$C_3H_7$— | $BF_4^-$ |
| 49 | O | t-$C_4H_9$— | H— | $CH_3$— | H— | t-$C_4H_9$— | $ClO_4^-$ |
| 50 | O | t-$C_4H_9$— | H— | $CH_3$— | H— | t-$C_4H_9$— | $BF_4^-$ |
| 51 | O | t-$C_4H_9$— | H— | t-$C_4H_9$— | H— | t-$C_4H_9$— | $ClO_4^-$ |
| 52 | O | t-$C_4H_9$— | H— | t-$C_4H_9$— | H— | t-$C_4H_9$— | $BF_4^-$ |

TABLE A-continued
| | | | | | | | |
|---|---|---|---|---|---|---|---|
| 53 | O | 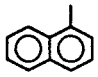 | H— | 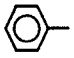 | H— | 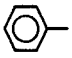 | $BF_4^-$ |
| 54 | O | 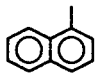 | H— | 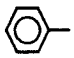 | H— | 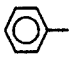 | $ClO_4^-$ |
| 55 | O | 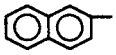 | H— | 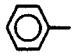 | H— | 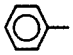 | $BF_4^-$ |
| 56 | O | 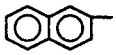 | H— | 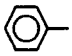 | H— | 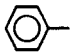 | $ClO_4^-$ |
| 57 | O | $C_6H_5CH_2$— | H— | 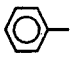 | H— | 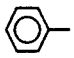 | $BF_4^-$ |
| 58 | O | $C_6H_5CH_2$— | H— | 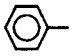 | H— | 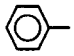 | $ClO_4^-$ |
| 59 | O | 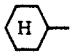 | H— | $CH_3$— | H— | $CH_3$— | $BF_4^-$ |
| 60 | O | 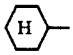 | H | $CH_3$— | H | $CH_3$— | $ClO_4^-$ |
| 61 | O | 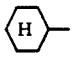 | H— | 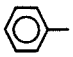 | H— | 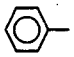 | $BF_4^-$ |
| 62 | O | 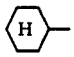 | H— | 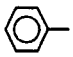 | H— | 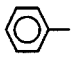 | $ClO_4^-$ |
| 63 | O | n-$C_{18}H_{37}$— | H— | $CH_3$— | H— | $CH_3$— | $BF_4^-$ |
| 64 | O | n-$C_{18}H_{37}$— | H— | $CH_3$— | H— | $CH_3$— | $ClO_4^-$ |
| 65 | O | n-$C_{18}H_{37}$— | H— | 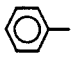 | H— | 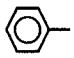 | $ClO_4^-$ |
| 66 | O | n-$C_{18}H_{37}$— | H— | 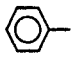 | H— | 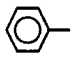 | $BF_4^-$ |
| 67 | O | 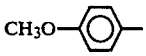 | H— | 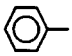 | H— | 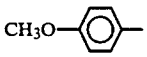 | $BF_4^-$ |
| 68 | O | 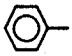 | 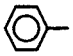 | H— | 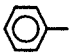 | 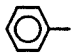 | $F_4^-$ |
| 69 | O | 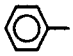 | 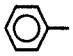 | 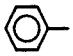 | 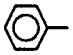 | 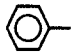 | $BF_4^-$ |
| 70 | O | 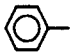 | H— | 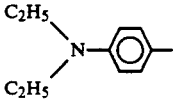 | H— | 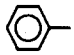 | $ClO_4^-$ |
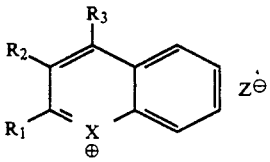
| No. | X | $R_1$ | $R_2$ | $R_3$ | $Z^\ominus$ |
|---|---|---|---|---|---|

TABLE A-continued
| | | | | | |
|---|---|---|---|---|---|
| 71 | O | 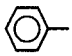 | $CH_3$— | H— | $ClO_4^-$ |
| 72 | O | 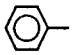 | $CH_3$— | H— | $BF_4^-$ |
| 73 | O | 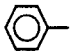 | $C_2H_5$— | H— | $ClO_4^-$ |
| 74 | O | 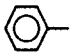 | $C_2H_5$— | H— | $BF_4^-$ |
| 75 | O | 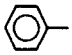 | $C_2H_5O$—C(=O)— | H— | $ClO_4^-$ |
| 76 | O | 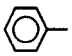 | $C_2H_5O$—C(=O)— | H— | $BF_4^-$ |
| 77 | O | 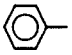 | 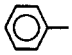 | H— | $ClO_4^-$ |
| 78 | O | 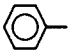 | 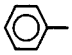 | H— | $BF_4^-$ |
| 79 | O | 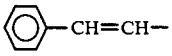 | $CH_3$— | H— | $ClO_4^-$ |
| 80 | O | 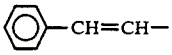 | $CH_3$— | H— | $BF_4^-$ |
| 81 | O | 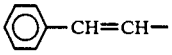 | 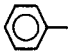 | H— | $ClO_4^-$ |
| 82 | O | 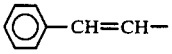 | 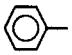 | H— | $BF_4^-$ |
| 83 | O | 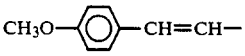 | 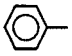 | H— | $ClO_4^-$ |
| 84 | O | 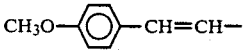 | 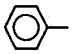 | H— | $BF_4^-$ |
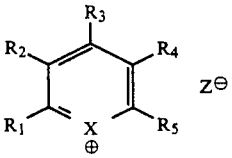
| No. | X | $R_1$ | $R_2$ | $R_3$ | $R_4$ | $R_5$ | $Z^\ominus$ |
|---|---|---|---|---|---|---|---|
| 85 | S | 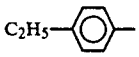 | H— | 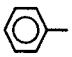 | H— | 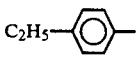 | $BF_4$— |
| 86 | S | 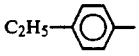 | H— | 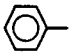 | H— | 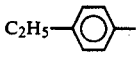 | $ClO_4$— |
| 87 | S | $CH_3$— | H— | 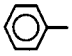 | H— | $CH_3$— | $BF_4$— |
| 88 | S | $CH_3$— | H— | 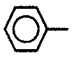 | H— | $CH_3$— | $ClO_4$— |
| 89 | S | $CH_3$— | H— | $CH_3$— | H— | $CH_3$— | $BF_4$— |

TABLE A-continued

| | | | | | | | |
|---|---|---|---|---|---|---|---|
| 90 | S | $CH_3$— | H— | $CH_3$— | H— | $CH_3$— | $ClO_4$— |
| 91 | S | $C_2H_5$— | H— | 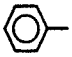 | H— | $C_2H_5$— | $BF_4$— |
| 92 | S | $C_2H_5$— | H— | 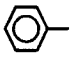 | H— | $C_2H_5$— | $ClO_4$— |
| 93 | S | $C_2H_5$— | H— | $C_2H_5$— | H— | $C_2H_5$— | $BF_4$— |
| 94 | S | $C_2H_5$— | H— | $C_2H_5$— | H— | $C_2H_5$— | $ClO_4$— |
| 95 | S | t-$C_4H_9$— | H— | t-$C_4H_9$— | H— | t-$C_4H_9$— | $BF_4$— |
| 96 | S | t-$C_4H_9$— | H— | t-$C_4H_9$— | H— | t-$C_4H_9$— | $ClO_4$— |
| 97 | S | $CH_3$— | H— | $C_2H_5$— | H— | $CH_3$— | $BF_4$— |
| 98 | S | $CH_3$— | H— | $C_2H_5$— | H— | $CH_3$— | $ClO_4$— |
| 99 | S | 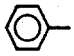 | H— | 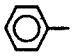 | H— | 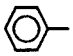 | $ClO_4$— |
| 100 | S | 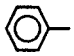 | H— | 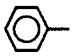 | H— | 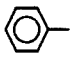 | $BF_4$— |
| 101 | S | 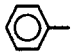 | H— | 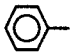 | H— | 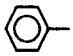 | $Cl^-$ |
| 102 | S | 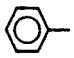 | H— | 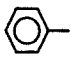 | H— | 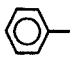 | $CH_3$— 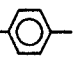 —$SO_3^-$ |
| 103 | S | 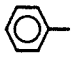 | H— | $CH_3$— 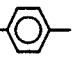 | H— | 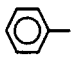 | $ClO_4$— |
| 104 | S | 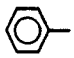 | H— | $CH_3$— 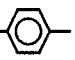 | H— | 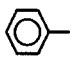 | $BF_4$— |
| 105 | S | 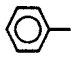 | H— | $CH_3O$— 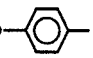 | H— | 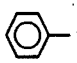 | $ClO_4$— |
| 106 | S | 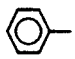 | H— | $CH_3O$— 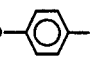 | H— | 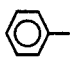 | $BF_4$— |
| 107 | S | 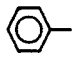 | H— | Cl— 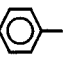 | H— | 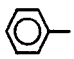 | $ClO_4$— |
| 108 | S | 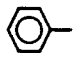 | H— | Cl— 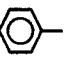 | H— | 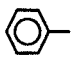 | $BF_4$— |
| 109 | S | $CH_3$—  | H— | $CH_3$— 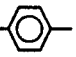 | H— | $CH_3$— 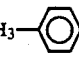 | $ClO_4$— |
| 110 | S | $CH_3$—  | H— | $CH_3$— 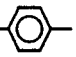 | H— | $CH_3$— 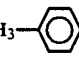 | $BF_4$— |
| 111 | S | $CH_3$—  | H— | $CH_3O$— 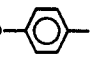 | H— | $CH_3$— 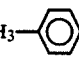 | $ClO_4$— |
| 112 | S | $CH_3$—  | H— | $CH_3O$— 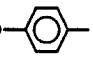 | H— | $CH_3$— 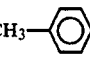 | $BF_4$— |
| 113 | S | 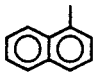 | H— | 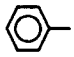 | H— | 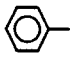 | $ClO_4$— |

TABLE A-continued

| | | | | | | | |
|---|---|---|---|---|---|---|---|
| 114 | S | 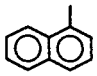 | H— | 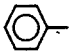 | H— | 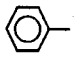 | $BF_4$— |
| 115 | S | 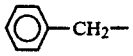 | H— | 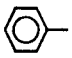 | H— | 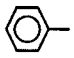 | $ClO_4$— |
| 116 | S | 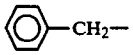 | H— | 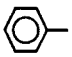 | H— | 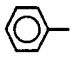 | $BF_4^-$ |
| 117 | S | 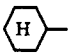 | H— | $CH_3$— | H— | $CH_3$— | $ClO_4^-$ |
| 118 | S | 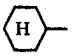 | H— | $CH_3$— | H— | $CH_3$— | $BF_4$— |
| 119 | S | n-$C_{18}H_{37}$— | H— | $CH_3$— | H— | $CH_3$— | $ClO_4^-$ |
| 120 | S | n-$C_{18}H_{37}$— | H— | $CH_3$— | H— | $CH_3$— | $BF_4^-$ |
| 121 | S | 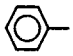 | 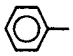 | 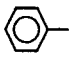 | H— | 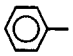 | $BF_4^-$ |
| 122 | S | 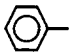 | 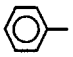 | 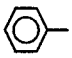 | 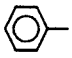 | 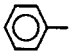 | $BF_4^-$ |
| 123 | S | 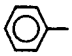 | H— | 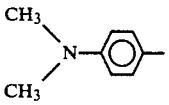 | H— | 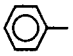 | $ClO_4^-$ |

The electric charge-generating organic pigment to be used along with the pyrylium compound is an organic pigment which itself has positive hole transporting properties.

When organic pigments which do not have positive hole transporting properties, for example, organic pigments having electron transporting properties, such as azo pigments and polynuclear quinone-based pigments, are used, the resulting photoreceptor do not have increased sensitivity. It is, however, greatly increased in the rate of dark-damping and thus is markedly reduced in electrification properties. Thus such electrophotographic photoreceptor is unsuitable for practical use.

Whether or not an organic pigment has positive hole transporting properties can be determined as follows: The pigment is vacuum deposited on a substrate, or alternatively, a high concentration of the pigment is dispersed in a resin and the dispersion is coated on the substrate to form a thin layer; the thin layer is then charged positively or negatively; and light damping is then measured.

Those pigments having large light damping in positive charging are preferred for use as the electric charge generating organic pigment having positive hole transporting properties. On the other hand, those pigments having large light damping in negative charging have electron transporting properties and thus cannot be used for the above purpose.

Electric charge generating organic pigments having positive hole transferring properties which are useful in the present invention include squarylium pigments, phthalocyanine pigments, perillen pigments, perinone pigments, quinacridone pigments and the like. Among these, squarylium pigments, phthalocyanine pigments and perillen pigments are preferred.

Exemplary useful phthalocyanine pigments include non-metal phthalocyanine, copper phthalocyanine, vinadyl phthalocyanine, titanyl phthalocyanine, aluminum phthalocyanine, gallium phthalocyanine, indium phthalocyanine, thallium phthalocyanine, silicon phthalocyanine, germanium phthalocyanine, tin phthalocyanine, lead phthalocyanine, and halides of the above phthalocyanines.

Exemplary useful squarylium pigments are shown below.

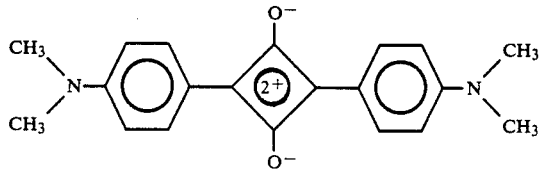

-continued
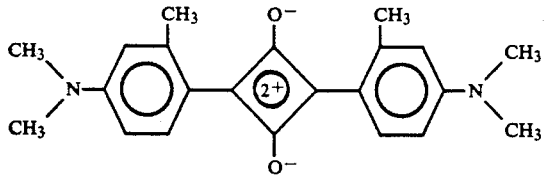
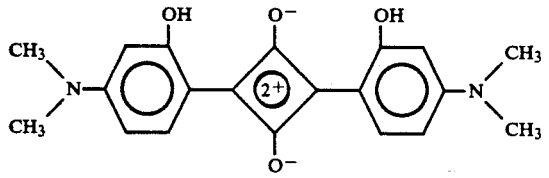
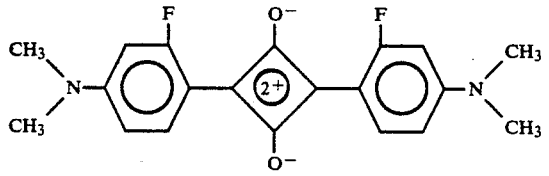
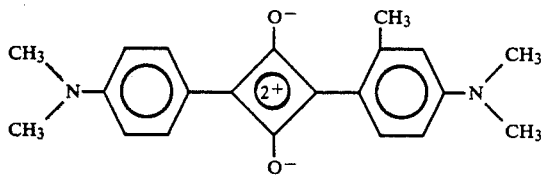
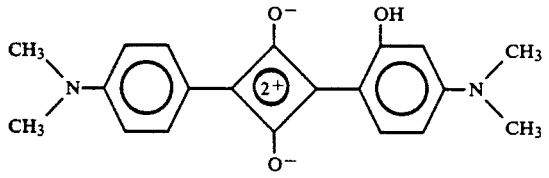
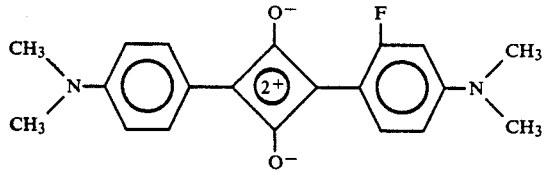
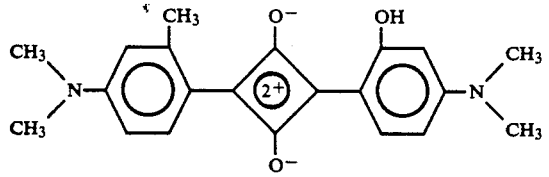
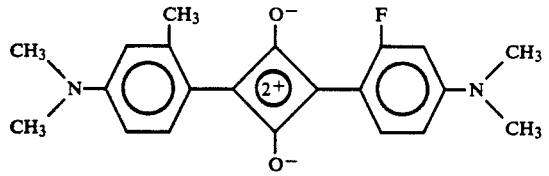
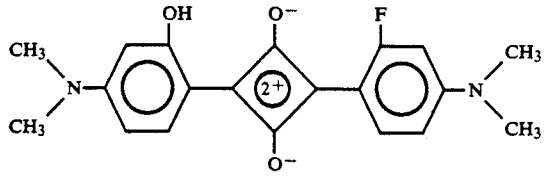

-continued
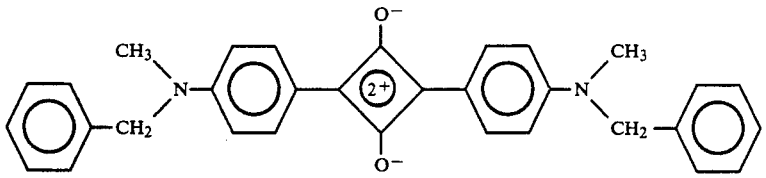
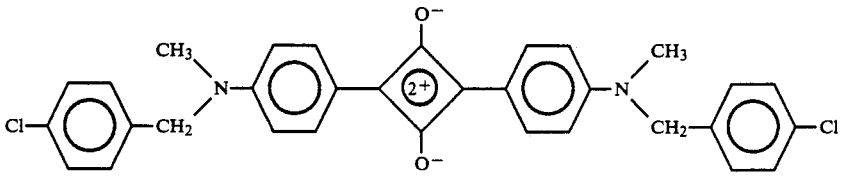
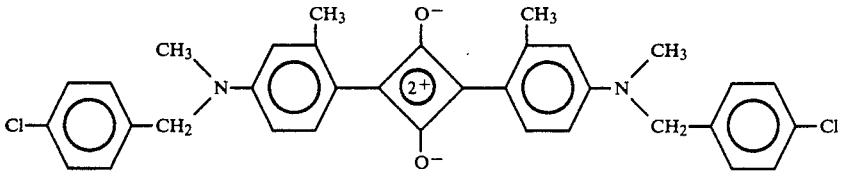
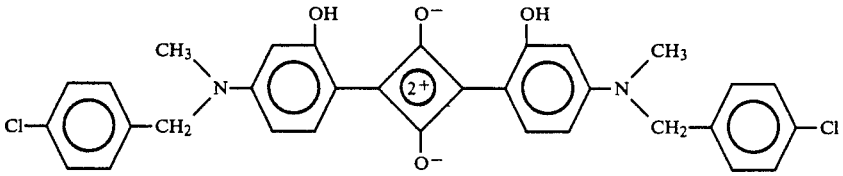
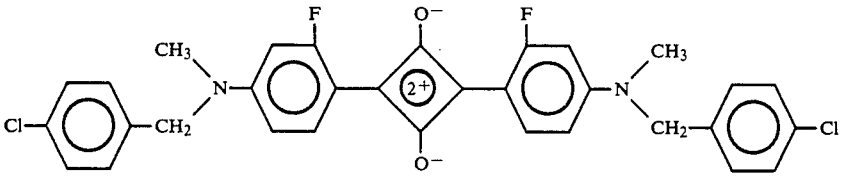
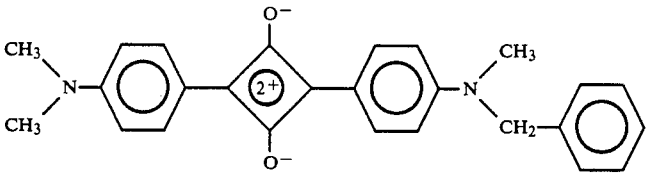
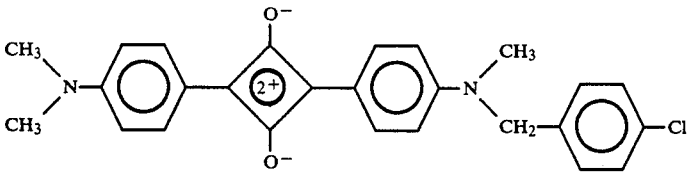
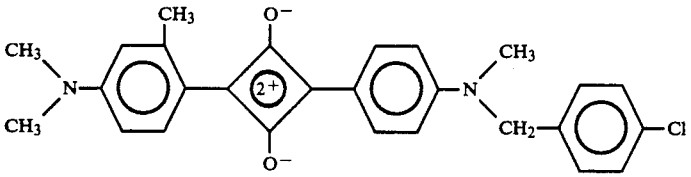
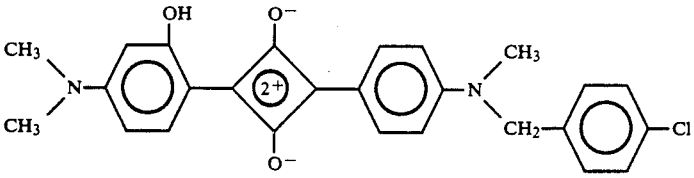

-continued
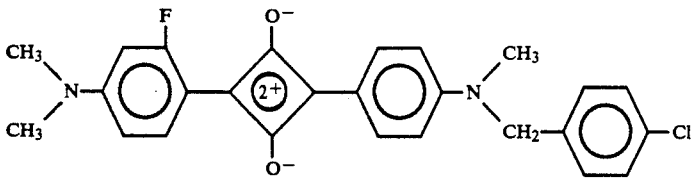
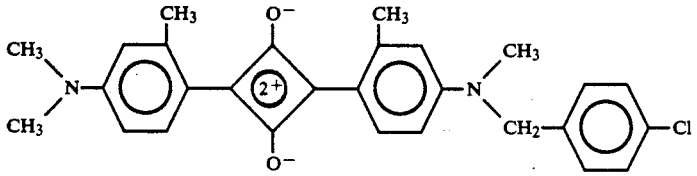
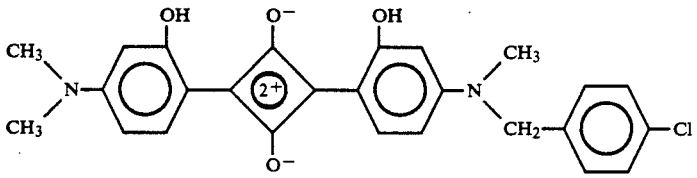
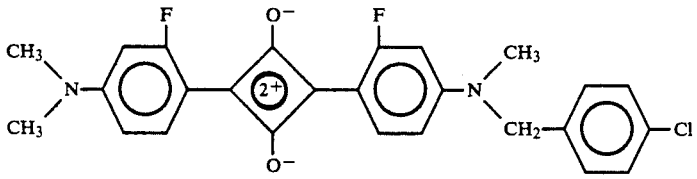
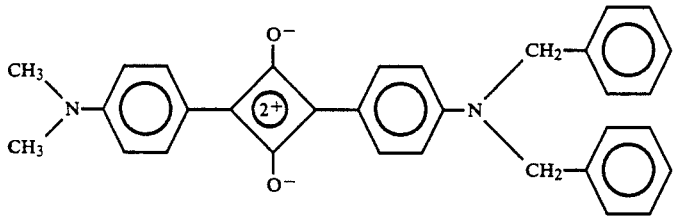
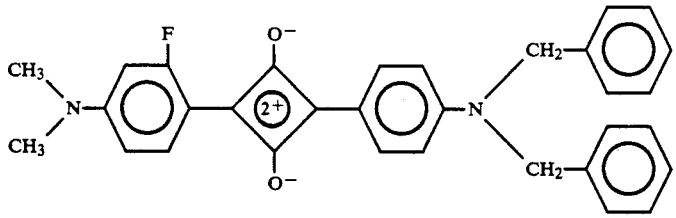
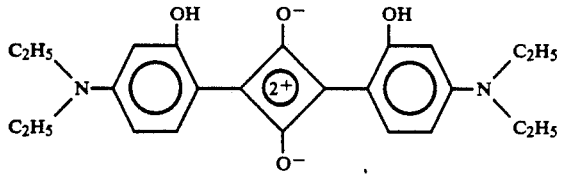
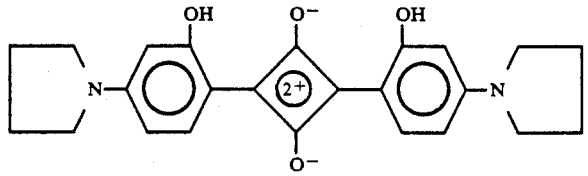

-continued
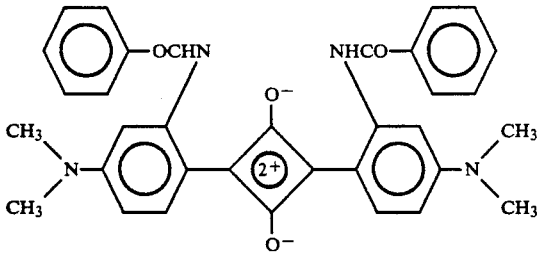
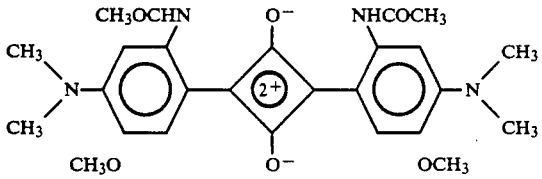
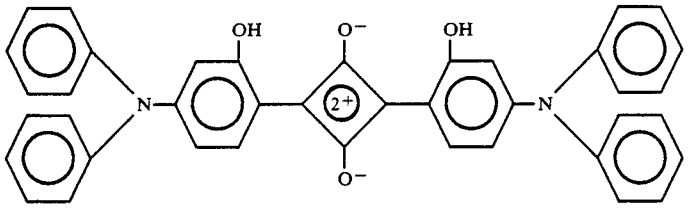
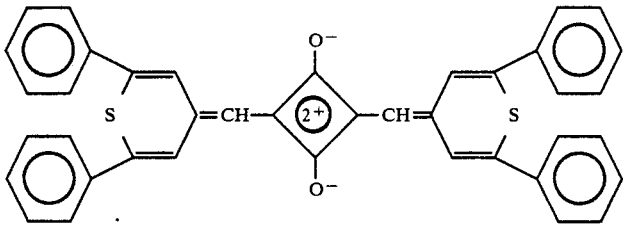
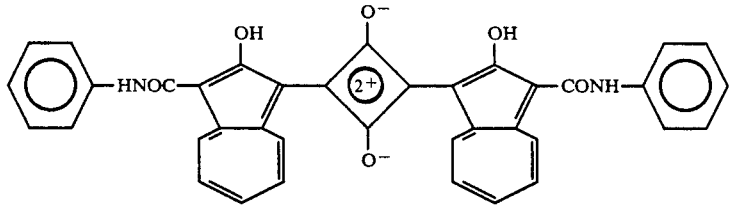
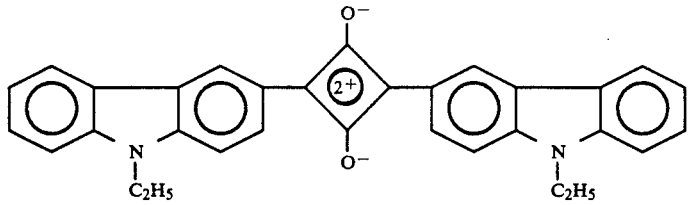
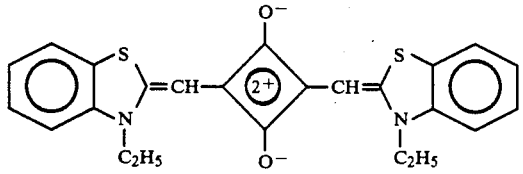

-continued
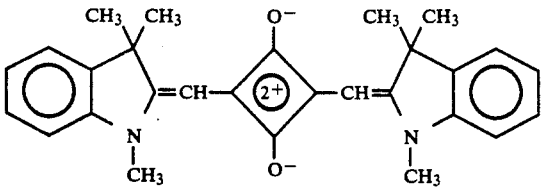
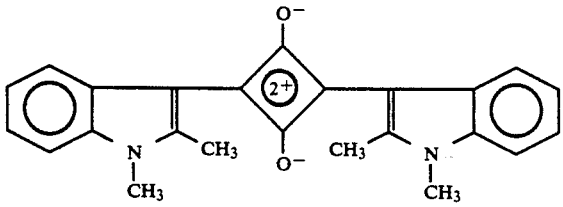
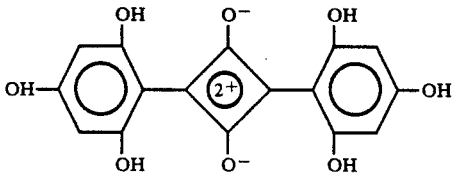
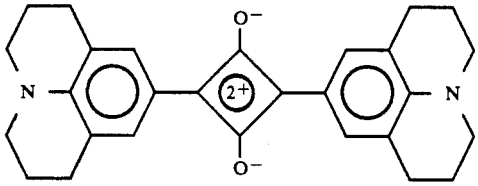
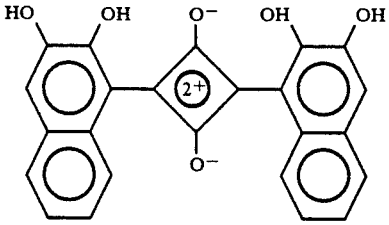
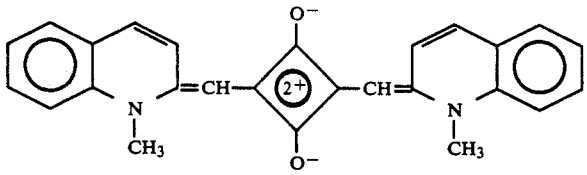
Examples of useful perillen pigments are shown by the formulae below.
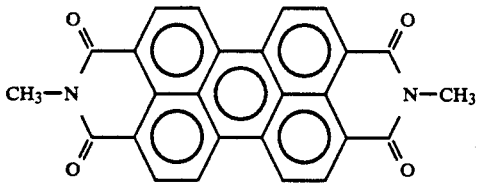

-continued
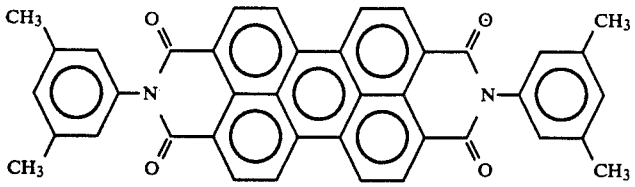
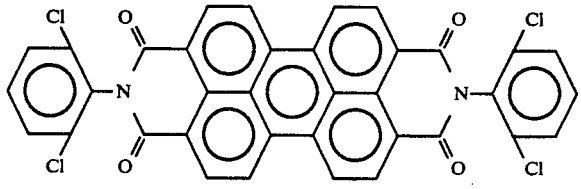
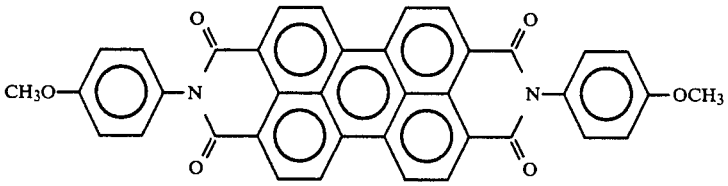
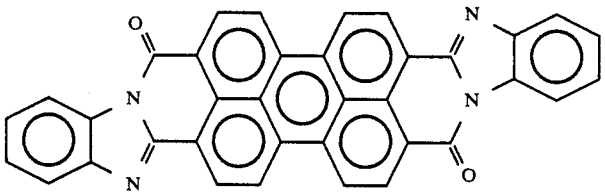
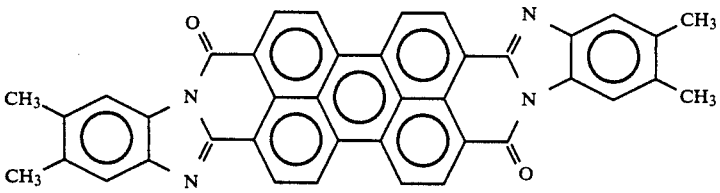
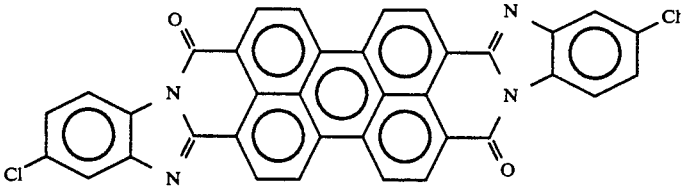
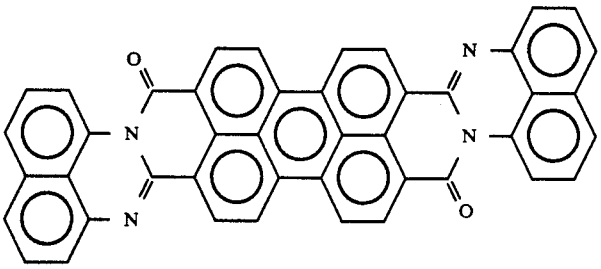

-continued
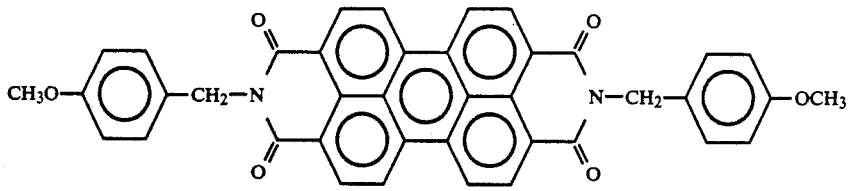
Examples of useful perinone pigments are shown by the formulae below.
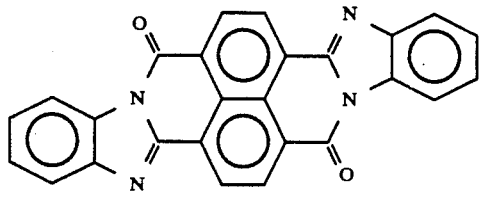
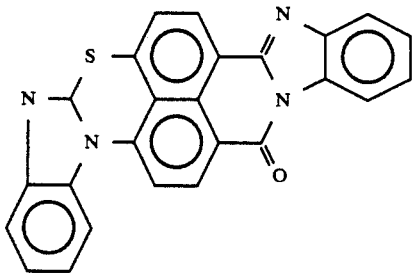
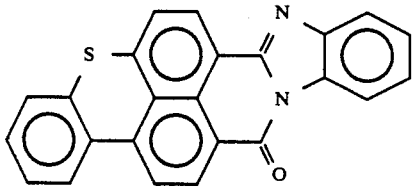
-continued
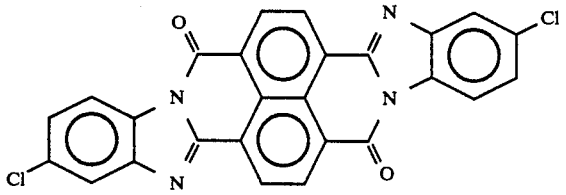
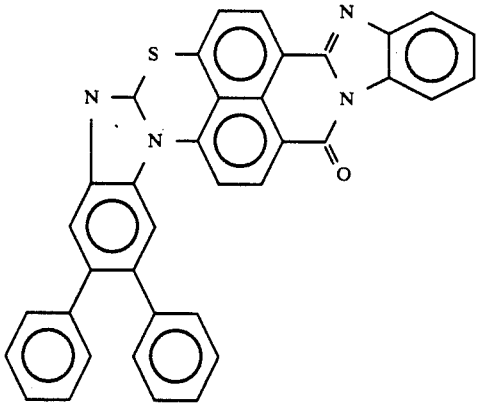
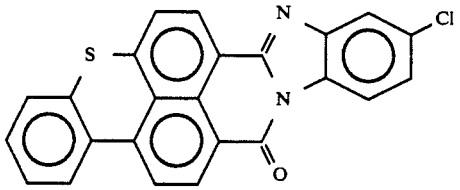
Examples of useful quinacridone pigments are shown by the formulae below.
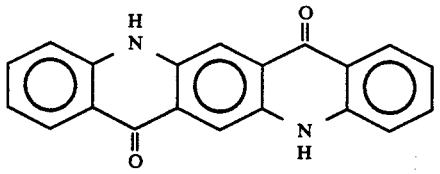
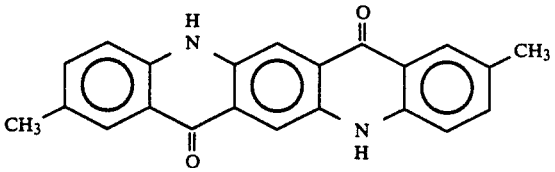

-continued

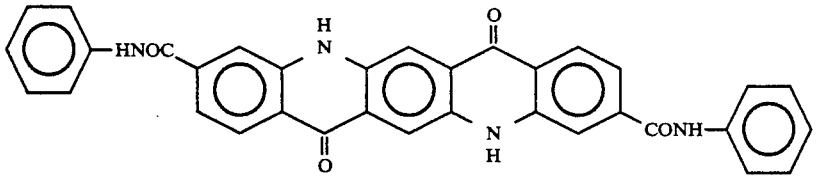

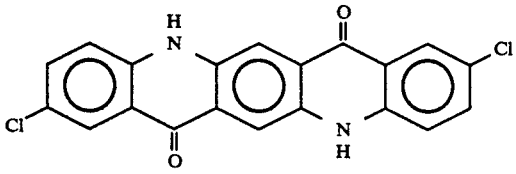

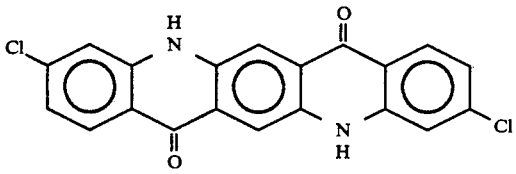

The electric charge-generating layer may be formed on the electrically conductive substrate by dispersing the above electric charge generating organic pigment in a binder resin and coating the resulting dispersion, or by sublimation or vacuum deposition of the electric charge-generating organic pigment, or by dissolving the electric charge generating organic pigment in a suitable organic solvent and coating the resulting solution.

When the electric charge-generating organic pigment is dispersed in a binder resin, it is preferred that the electric charge generating organic pigment be dispersed in a fine particle form, with the average particle diameter being 3 μm or less and preferably 0.3 μm or less. It is also preferred that the amount of the electric charge generating organic pigment compounded is preferably from 0.25 to 10 parts by weight and particularly preferably from 0.5 to 7 parts by weight, per part by weight of the binder resin. The pyrylium compound may be dispersed in the binder resin or dissolved in a solvent along with the binder resin and then coated. Alternatively, the pyrylium salt compound may be dissolved in a suitable solvent, into which the electric charge generating layer containing the electric charge generating organic pigment is dipped.

The amount of the pyrylium compound compounded in the electric charge generating layer is preferably 0.001 to 0.5 part by weight and particularly preferably from 0.01 to 0.3 part by weight, per part by weight of the electric charge generating organic pigment.

Exemplary binder resins which can be used in the present invention include polystyrene, silicon resin, polycarbonate, acrylic resin, methacrylic resin, polyester, vinyl polymer such as polyvinyl butyral and the like, celluloses such as cellulose ester, cellulose ether, and alkyd resin.

The electric charge transporting layer contains an electric charge transporting substance. Examplary electric charge transporting substances which can be used include, hydrazones such as N-methyl-N-phenylhydrazino-3-methylidene-9-ethylcarbazole, N,N-diphenylhydrazino-3-methylidene-9-ethylcarbazole, N,N-diphenylhydrazino-3-methylidene-9-methylcarbazole, p-diethylaminobenzaldehyde-N,N-diphenylhydrazone, p-diethylaminobenzaldehyde-N,N-di(p-methoxyphenyl)hydrazone, p-diethylaminobenzaldehyde-N-(α-naphthyl)-N-phenylhydrazone, β,β-di(4-methoxyphenyl)acroleindiphenylhydrazone and the like; pyrazolines such as 1-phenyl-3-(p-diethylaminostyryl)-5-(p-diethylaminostyryl)-5-(p-diethylaminophenyl)-pyrazoline, 1[quinolyl(2)]-3-(p-diethylaminostyryl)-5-(p-diethylaminophenyl)pyrazoline; oxazole-based compounds such as 2-(p-dipropylaminophenyl)-4-(p-dimethylaminophenyl)-5-(2-chlorophenyl)oxazole, 2-(p-diethylaminostyryl)-6diethylaminobenzoxazole; oxadiazole-based compounds such as 2,5-bis(p-diethylaminophenyl)-1,3,4-oxadiazole, 2,5-bis(4'-diethylamino-2'-methylphenyl)-1,3,4-oxadiazole and the like; triarylmethane-based compounds such as bis(4-diethylamino-2-methylphenyl)phenylmethane; triarylamine-based compounds such as triphenylamine, 2,4',4''-trimethyltriphenylamine, 1,1-bis(4'-N,N-di(p-methylphenyl)aminophenyl]cyclohexane; anthracene-based compounds such as 5-(p-diethylaminostyrylanthracene; stilbene-based compounds such as α-phenyl-4'-N,N-diphenylaminostilbene, 4'-N,N-di(p-methoxyphenyl) aminostilbene; benzidine-based compounds such as N,N'-diphenyl - N,N'-bis(3-methylphenyl)-[1,1'-biphenyl]-4, 4'-diamine, 3,3'-dimethyl-N,N,N',N'-tetrakis(4-methylphenyl)-[1,1'-biphenyl]4,4'-diamine. Among these, hydrazones, triarylmethane-based compounds and benzidine-based compounds are preferred.

The electric charge transporting layer may be formed, in the manner described above for the electric charge generating layer, namely, by dispersing the above electric charge transporting material in the aforementioned binder resin and coating the resulting dispersion.

In addition to the above, photoconductive polymers such as poly-N-vinyl carbazole, halogenated poly-N-vinyl carbazole, polyvinyl anthracene, poly-9-vinylphenyl anthracene, polyvinyl pyrene, polyvinyl acridine, polyvinyl acenaphthalene, polyglycidyl carbazole, a pyrene-formaldehyde resin, ethyl carbazole-formaldehyde resin or the like can be used as the electric charge transporting substance. These may form a layer alone, without the need for a binder resin.

In the electrophotographic photoreceptor of the present invention, either the electric charge generating layer or the electric charge transporting layer may be provided as the upper layer. In a case where the electric charge generating layer is provided as the upper layer, the resulting electrophotographic light-sensitive material is positively charged, while on the other hand in a case where the electric charge transporting layer is provided as the upper layer, the resulting electrophotographic light-sensitive material is negatively charged.

In the electrophotographic photoreceptor of the present invention, an adhesive layer may be provided between the light-sensitive layer and the electrically conductive substrate. This adhesive layer may be of a commonly used synthetic resin such as polyester. The adhesive layer usually has a thickness of about 0.1 to 5 μm, and preferably has a thickness of about 0.1 to 3 μm.

The electric charge generating layer generally has a thickness of from 0.05 to 10 μm and preferably has a thickness of from 0.1 to 5 μm. The electric charge transporting layer generally has a thickness of from 5 to 50 μm, and preferably has a thickness of from 10 to 30 μm.

The laminate type electrophotographic photoreceptor of the present invention is characterized in that the electric charge generating layer contains a pyrylium salt compound and an electric charge generating organic pigment having positive hole transporting properties.

When an electric charge generating organic pigment having positive hole transporting properties is introduced in the electric charge generating layer along with a pyrylium compound, no change in the shape of the spectral sensitive spectrum is observed and only the absolute value of the sensitivity is increased, in contrast to the case where no pyrylium compound is added.

No change in the spectral sensitivity after the addition of the pyrylium compound indicates that even if the pyrylium compound absorb light, it does not generate an electric charge. When the pyrylium compound is added according to the present invention, no spectrum corresponding to the spectral sensitivity of the pyrylium compound itself is observed. Since no new spectral peak is observed between a material in which the pyrylium compound is added and a material in which no pyrylium compound is added, it is believed that neither an eutectic complex nor an electric charge transfer complex is formed.

When a pyrylium compound is added along with an electric charge generating organic pigment having positive hole transporting properties, only the absolute value of sensitivity of the resulting light-sensitive material is increased according to a mechanism completely different form the mechanism of spectral sensitization and chemical sensitization.

The invention will be further clarified by the following examples, which are intended to be purely exemplary of the invention.

EXAMPLE 1

One part by weight of a polyvinyl butyral resin (trade name, "BLX", produced by Sekisui Chemical Co., Ltd.) and 0.04 part by weight of 2,4,6-triphenylpyrylium tosylate were dissolved in 40 parts by weight of n-butanol. 0.4 part by weight of X-type non-metal phthalocyanine was added thereto and well dispersed therein by the use of a paint shaker. The resulting dispersion was coated on an aluminum sheet by the use of an applicator and then dried to form an electric charge-generating layer. The film thickness after drying of the electric charge-generating layer was 0.2 μm.

A uniform solution of 1 part by weight of N,N'-diphenyl-N,N'-bis(3-methylphenyl)-[1,1'-biphenyl]-4,4'-diamine, 1 part by weight of a polycarbonate resin (trade name, "Lexan 145", produced by General Electric Corp.; molecular weight, 35,000–40,000) and 15 parts by weight of dichloromethane were coated on the above electric charge-generating layer and then dried to form an electric charge transporting layer. The film thickness of the electric charge transporting layer was 15 μm.

The electrophotographic photoreceptor thus produced was subjected to the following evaluation of characteristics by the use of an electrostatic copying paper tester ("SP-428" produced by Kawaguchi Denki Seisakusho Co., Ltd.).

The light-sensitive material was first negatively charged by applying corona charging of −6 KV and then was allowed to stand for 2 seconds in a dark place. At this point, the surface electric potential Vpo (volt) was measured. Then, the material was irradiated by the use of a tungsten lamp in such a manner that the illumination on the surface was 5 lux. The times taken for the surface potential to reach ½ and 1/5 of Vpo were measured. Based on these exposure amounts El/2 (lux.sec) and El/5 (lux.sec) were calculated. The surface potential after irradiation with light for 10 seconds was made as Vpr (volt).

The same procedure as above was repeated 20 times.

Figure 2:
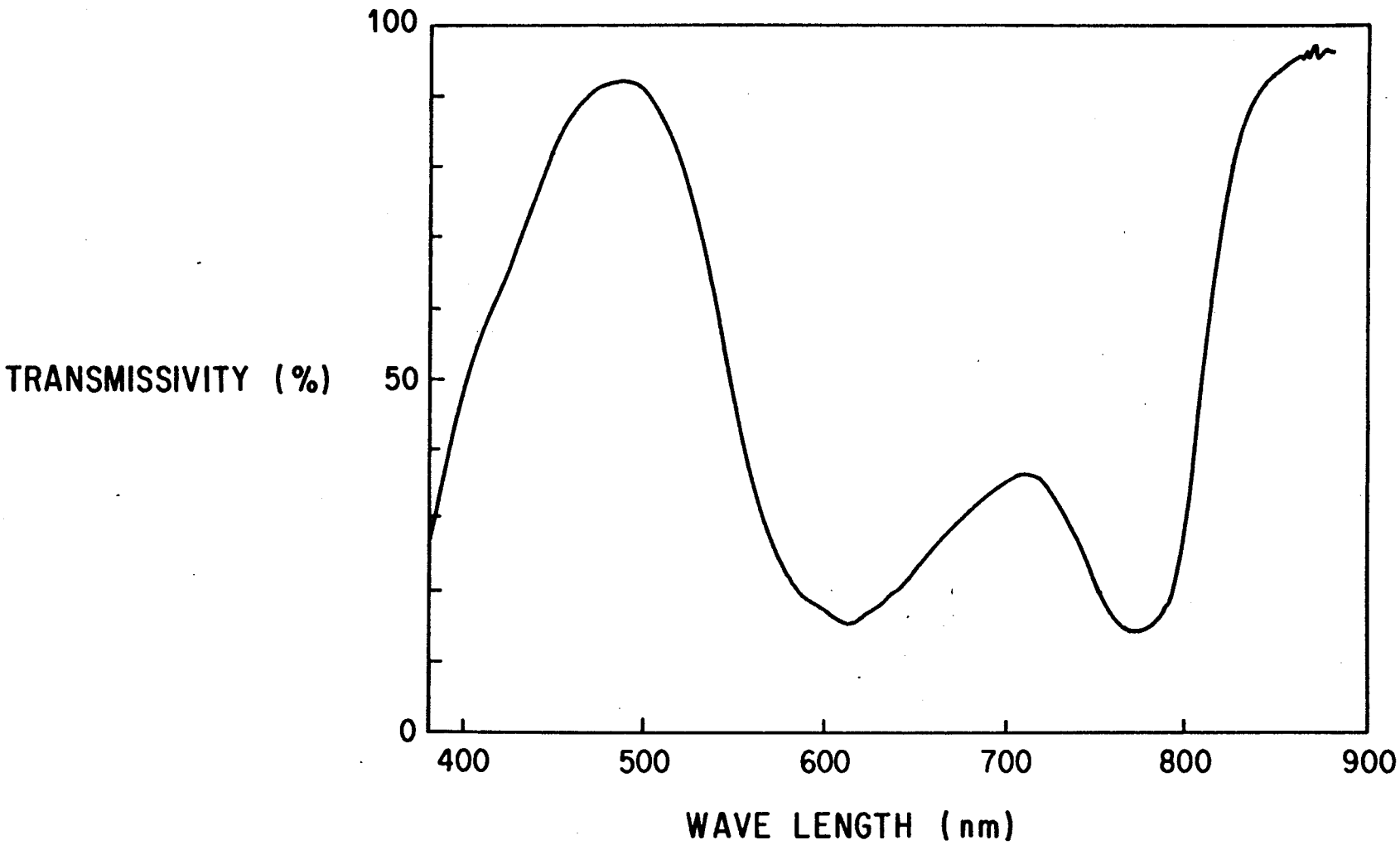
FIG. 2 is a graph showing absorption spectrum of the electrophotographic photoreceptor of Example 1 of the present invention.

The results are shown in Table 1. The spectral sensitivity and absorption spectrum of the electrophotographic photoreceptor are shown in FIGS. 1 and 2, respectively.

TABLE 1

| | 1st | 20th |
|---|---|---|
| Vpo (volt) | 850 | 840 |
| E½ (lux · sec) | 1.5 | 1.5 |
| E 1/5 (lux · sec) | 3.4 | 3.4 |
| Vpr (volt) | 0 | 0 |

COMPARATIVE EXAMPLE 1

Figure 3:
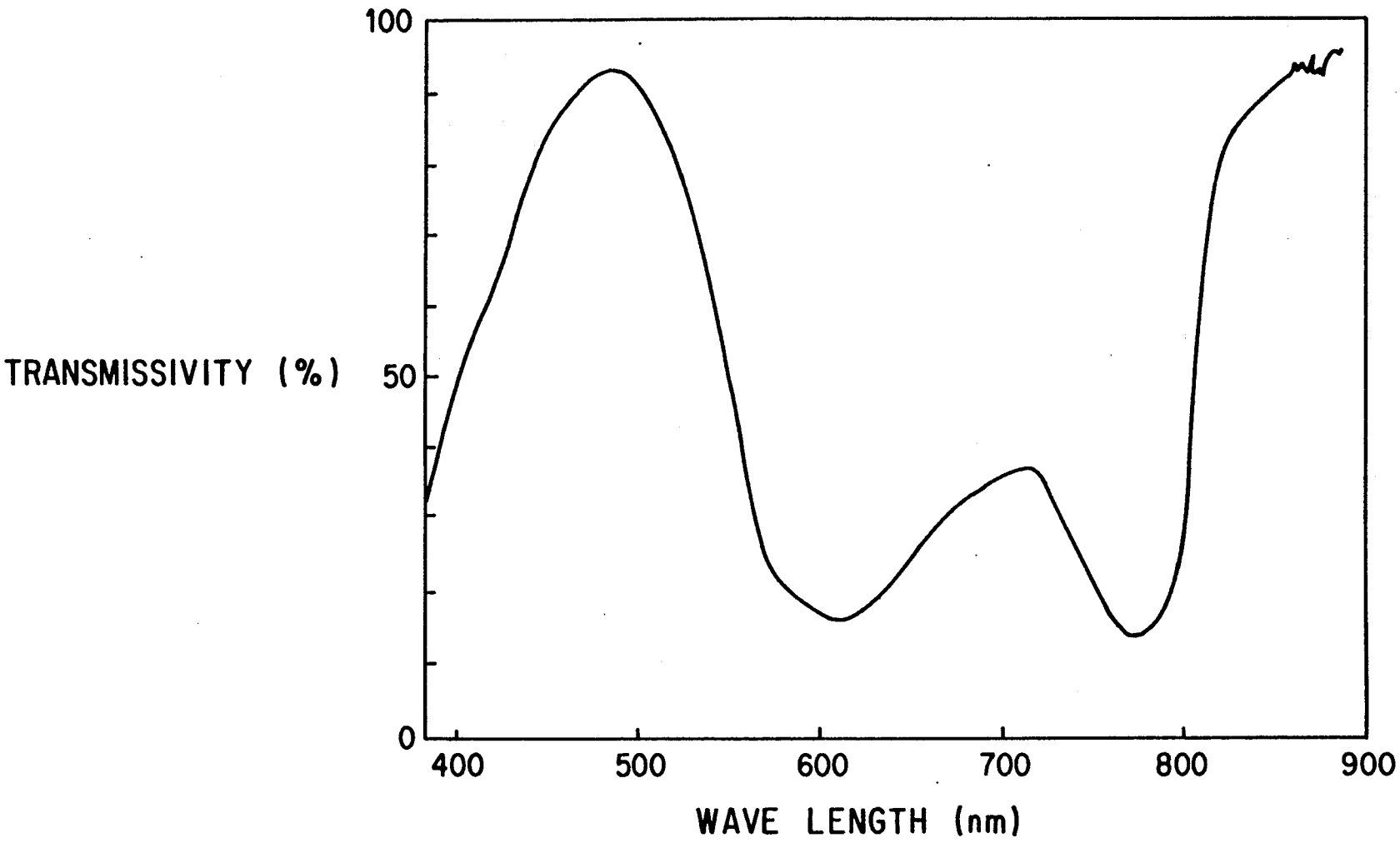
FIG. 3 is a graph showing absorption spectrum of the electrophotographic photoreceptor of Comparative Example 1.

An electrophotographic photoreceptor was produced and evaluated in the same manner as in Example 1 with the exception that 2,4,6-triphenylpyrylium tosylate was not used. The results are shown in Table 2. The spectral sensitivity and absorption spectrum of the electrophotographic photoreceptor are shown in FIGS. 1 and 3, respectively.

TABLE 2

| | 1st | 20th |
|---|---|---|
| Vpo (volt) | 900 | 850 |
| E½ (lux · sec) | 2.3 | 2.1 |
| E 1/5 (lux · sec) | 5.1 | 4.8 |
| Vpr (volt) | 5 | 10 |

EXAMPLE 2

An electrophotographic photoreceptor was produced and evaluated in the same manner as in Example 1 with the exception that a squarylium compound having the formula shown below was used in place of the X-type non-metal phthalocyanine. The results are shown in Table 3.

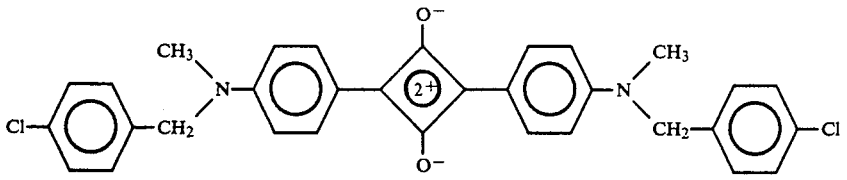

TABLE 3

| | 1st | 20th |
|---|---|---|
| Vpo (volt) | 750 | 730 |
| E½ (lux · sec) | 3.0 | 3.0 |
| E1/5 (lux · sec) | 6.6 | 6.5 |
| Vpr (volt) | 0 | 0 |

COMPARATIVE EXAMPLE 2

An electrophotographic photoreceptor was produced and evaluated in the same manner as in Example 2 with the exception that 2,4,6-triphenylpyrylium tosylate was not added. The results are shown in Table 4.

TABLE 4

| | 1st | 20th |
|---|---|---|
| Vpo (volt) | 780 | 725 |
| E½ (lux · sec) | 5.4 | 5.2 |
| E 1/5 (lux · sec) | 15.0 | 14.5 |
| Vpr (volt) | 40 | 40 |

EXAMPLE 3

An electrophotographic photoreceptor was produced and evaluated in the same manner as in Example 1 with the exception that the amount of 2,4,6-triphenylpyrlium tosylate was changed from 0.04 part by weight to 0.4 part by weight and 4 parts by weight of a perillen pigment (Novoparm Red BL, produced by Hoechst Co.) having the formula shown below was used in place of 0.4 part by weight of the X-type non-metal phthalocyanine.

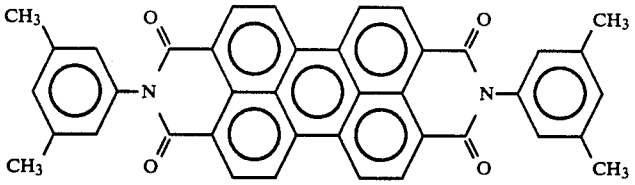

The results are shown in Table 5.

TABLE 5

| | 1st | 20th |
|---|---|---|
| Vpo (volt) | 800 | 795 |
| E½ (lux · sec) | 6.0 | 6.0 |
| E 1/5 (lux · sec) | 10.1 | 10.1 |
| Vpr (volt) | 0 | 0 |

COMPARATIVE EXAMPLE 3

An electrophotographic photoreceptor was produced and evaluated in the same manner as in Example 3 with the exception that 2,4,6-triphenylpyrylium tosylate was not added. The results are shown in Table 6.

TABLE 6

| | 1st | 20th |
|---|---|---|
| Vpo (volt) | 780 | 790 |
| E½ (lux · sec) | 9.8 | 10.0 |
| E 1/5 (lux · sec) | 20.0 | 22.1 |
| Vpr (volt) | 0 | 15 |

EXAMPLE 4

An electrophotographic photoreceptor was produced and evaluated in the same manner as in Example 3 with the exception that a perinone pigment having the formula shown below (Hostaperm Orange GR, produced by Hoechst Co.) was used in place of the perillen pigment.

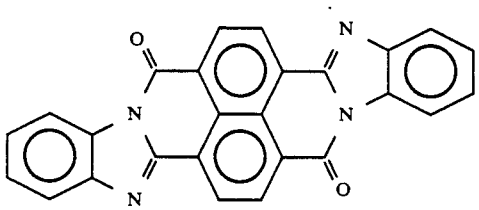

The results are shown in Table 7.

TABLE 7

| | 1st | 20th |
|---|---|---|
| Vpo (volt) | 780 | 770 |
| E½ (lux · sec) | 17.5 | 17.3 |
| E 1/5 (lux · sec) | 30.0 | 29.5 |
| Vpr (volt) | 10 | 10 |

COMPARATIVE EXAMPLE 4

An electrophotographic photoreceptor was produced and evaluated in the same manner as in Example 4 with the exception that 2,4,6-triphenylpyrylium tosylte was not added. The results are shown in Table 8.

TABLE 8

| | 1st | 20th |
|---|---|---|
| Vpo (volt) | 800 | 780 |
| E½ (lux · sec) | 23.4 | 23.5 |
| E 1.5 (lux · sec) | 40.0 | 41.0 |
| Vpr (volt) | 70 | 80 |

EXAMPLES 5 TO 8

Electrophotographic photoreceptors were produced and evaluated in the same manner as in Example 2 with the exception that pyrylium compound Nos. 7, 66, 68 and 99 shown hereinabove in Table 7 (Examples 5, 6, 7 and 8, respectively) were used in place of 2,4,6-triphenylpyrylium tosylate, and methylene chloride was used in place of n-butanol. The results are shown in Table 9 for the 1st measurement.

TABLE 9

| | Vpo (volt) | E½ (lux · sec) | E1/5 (lux · sec) | Vpr (volt) |
|---|---|---|---|---|
| Example 5 | 780 | 3.2 | 6.8 | 0 |
| Example 6 | 810 | 3.2 | 6.7 | 0 |
| Example 7 | 765 | 2.9 | 6.4 | 5 |
| Example 8 | 770 | 3.9 | 8.5 | 0 |

COMPARATIVE EXAMPLE 5

An electrophotographic photoreceptor was produced and evaluated in the same manner as in Example 3 with the exception that an antantrone pigment having the formula shown below (Monolite Red 2Y, produced by ICI Corp.) was used in place of the perillen pigment. The results are shown in Table 10. The electric potential just after charging was indicated in VO (volt), and dark-damping rate (DDR), in VO-Vpo/Vox 100%.

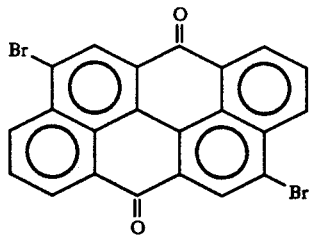

COMPARATIVE EXAMPLE 6

An electrophotographic photoreceptor was produced and evaluated in the same manner as in Comparative Example 5 with the exception that 2,4,6-triphenylpyrylium tosylate was not added. The results are shown in Table 10.

TABLE 10

| | Vpo (volt) | DDR (%) | E½ (lux · sec) | E1/5 (lux · sec) | Vpr (volt) |
|---|---|---|---|---|---|
| Comparative Example 5 | 300 | 15.0 | 10.5 | 19.1 | 0 |
| Comparative Example 6 | 635 | 3.7 | 12.0 | 19.4 | 0 |

COMPARATIVE EXAMPLE 7

An electrophotographic photoreceptor was produced and evaluated in the same manner as in Example 1 with the exception that the amount of 2,4,6-triphenylpyrylium tosylate used was changed from 0.04 part by weight to 0.1 part by weight, and 1 part by weight of an azo pigment having the formula shown below was used in place of 0.4 part by weight of X-type non-metal phthalocyanine. The results are shown in Table 11.

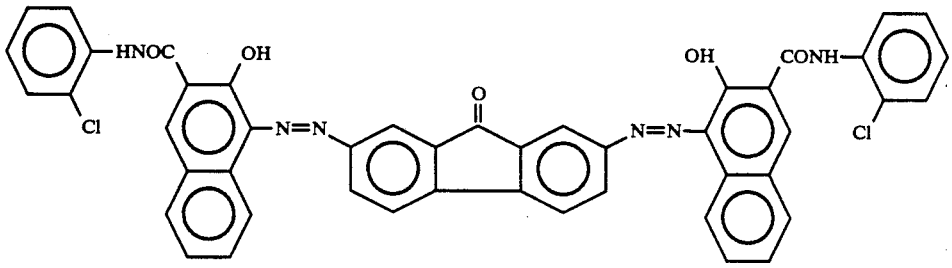

COMPARATIVE EXAMPLE 8

An electrophotographic photoreceptor was produced and evaluated in the same manner as in Comparative Example 7 with the exception that 2,4,6-triphenylpyrylium tosylate was not added. The results are shown in Table 11.

TABLE 11

| | Vpo (volt) | DDR (%) | E½ (lux · sec) | E1/5 (lux · sec) | Vpr (volt) |
|---|---|---|---|---|---|
| Comparative Example 7 | 370 | 18.5 | 9.0 | 20.0 | 0 |
| Comparative Example 8 | 8.0 | 1.0 | 12.4 | 23.5 | 0 |

The electrophotographic photoreceptor of the present invention is, as described above, of the structure that an electric charge generating layer contains an electric charge generating organic pigment having positive hole transporting properties and a pyrylium compound, and is free from the problems of the conventional electrophotographic photoreceptor containing a pyrylium-based compound. That is, the electrophotographic photoreceptor of the present invention is good in electrification properties and has a small dark-damping rate and, therefore, has high sensitivity.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having thereon a light-sensitive layer, said light-sensitive layer comprising an electric charge generating layer and an electric charge transporting layer, wherein the electric charge generating layer contains an electric charge generating organic pigment having positive hole transporting properties and a pyrylium compound represented by the formula (I) or (II):

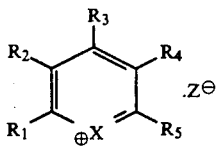

(I)

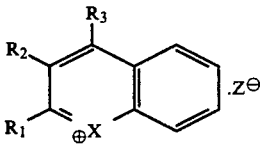

(II)

wherein X is an oxygen atom or a sulfur atom; $R_1$ and $R_5$ are each hydrogen, an alkyl group, a cycloalkyl group, an alkoxycarbonyl group, a benzyl group, a substituted or unsubstituted styryl group, or a substituted or unsubstituted phenyl group, and $Z\ominus$ is an anion, wherein an adhesive layer is provided between the light-sensitive layer and the electrically conductive substrate, wherein said electric charge generating layer is formed from a dispersion of said pigment and said pyrylium compound in a binder resin, wherein said electric charge generating organic pigment is present in an amount of from 0.25 to 10 parts by weight per part by weight of said binder resin, and wherein said pyrylium compound is present in an amount of from 0.001 to 0.5 part by weight per part by weight of said pigment.

2. The electrophotographic photoreceptor as claimed in claim 1, wherein the pyrylium compound is a pyrylium salt represented by the formula (III) or (IV):

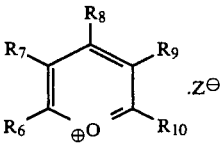

(III)

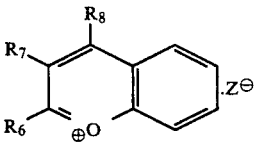

(IV)

wherein $R_6$ to $R_{10}$ are each hydrogen, an alkyl group or a substituted or unsubstituted phenyl group, and $Z\ominus$ is an anion.

3. The electrophotographic photoreceptor as claimed in claim 1, wherein said electric charge generating pigment is a pigment selected from the group consisting of squarylium, phthalocyanine, perillen, perinone, and quinacridone pigments.

4. The electrophotographic photoreceptor as claimed in claim 1, wherein said electric charge generating pigment is a squarylium pigment, a phthalocyanine pigment or a perillen pigment.

5. The electrophotographic photoreceptor as claimed in claim 1, wherein the electric charge generating organic pigment has an average particle diameter of 3 μm or less.

6. The electrophotographic photoreceptor as claimed in claim 1, wherein said electric charge generating layer comprises the electric charge generating organic pigment and the pyrylium compound which are dispersed in a binder resin, and said electric charge transporting layer comprises an electric charge transporting substance dispersed in a binder resin.

7. The electrophotographic photoreceptor as claimed in claim 6, wherein the electric charge generating organic pigment is present in an amount of from 0.25 to 10 parts by weight per part by weight of the binder resin.

8. The electrophotographic photoreceptor as claimed in claim 1, wherein an adhesive layer is provided between the light-sensitive layer and the electrically conductive substrate.

9. The electrophotographic photoreceptor as claimed in claim 8, wherein the adhesive layer has a thickness of 0.1 to 5.0 μm.

10. The electrophotographic photoreceptor as recited in claim 1, wherein in the electric charge generating layer, no change in the shape of the spectral sensitive spectrum is observed and only the absolute value of the sensitivity is increased.

11. The electrophotographic photoreceptor as claimed in claim 1, wherein in the electric charge generating layer, no spectrum corresponding to spectral sensitivity of the pyrylium compound is observed.

12. The electrophotographic photoreceptor as claimed in claim 1, wherein in the electric charge generating layer, no new spectral peak is observed between a material in which the pyrylium compound is added and a material in which no pyrylium compound is added.

13. The electrophotographic photoreceptor as claimed in claim 1, wherein in the electric charge generating layer, only the absolute value of sensitivity of the resulting light sensitive material is increased.

14. The electrophotographic photoreceptor as claimed in claim 1, wherein the amount of the pyrylium compound is from 0.01 to 0.3 part by weight per part by weight of the electric charge generating organic pigment.

* * * * *

UNITED STATES PATENT AND TRADEMARK OFFICE

CERTIFICATE OF CORRECTION

PATENT NO. : 5,024,911

DATED : June 18, 1991

INVENTOR(S) : Yutaka AKASAKI et al.

It is certified that error appears in the above-identified patent and that said Letters Patent is hereby corrected as shown below:

Abstract, line 25, change "and" to --an--.

Claim 1, column 39, line 15, after "$R_1$ change and to --to--.

Signed and Sealed this

Twenty-seventh Day of April, 1993

*Attest:*

MICHAEL K. KIRK

*Attesting Officer*

*Acting Commissioner of Patents and Trademarks*